US006694623B1

(12) United States Patent
Haughey

(10) Patent No.: US 6,694,623 B1
(45) Date of Patent: Feb. 24, 2004

(54) LEVER CHAIN ADJUSTER FOR A CHAIN SAW

(76) Inventor: Michael W. Haughey, 16 Ledgewood Dr., Canton, MA (US) 02021

( * ) Notice: Subject to any disclaimer, the term of this patent is extended or adjusted under 35 U.S.C. 154(b) by 0 days.

(21) Appl. No.: 10/164,251

(22) Filed: Jun. 6, 2002

(51) Int. Cl.[7] ..... B27B 17/14
(52) U.S. Cl. ..... 30/386
(58) Field of Search ..... 30/386, 385, 383; 83/816

(56) References Cited

U.S. PATENT DOCUMENTS

| | | | | |
|---|---|---|---|---|
| 2,765,821 | A | | 10/1956 | Strunk |
| 3,327,741 | A | | 6/1967 | Merz |
| 3,457,970 | A | | 7/1969 | Locati |
| 4,129,943 | A | | 12/1978 | Bricker |
| 4,315,370 | A | | 2/1982 | Horne |
| 4,382,334 | A | | 5/1983 | Reynolds |
| 4,567,658 | A | | 2/1986 | Wissmann et al. |
| 4,835,868 | A | | 6/1989 | Nagashima |
| 4,920,650 | A | | 5/1990 | Edlund |
| 4,999,918 | A | * | 3/1991 | Schliemann et al. ..... 30/386 |
| 5,070,618 | A | | 12/1991 | Edlund |
| 5,144,751 | A | | 9/1992 | Weber |
| 5,174,029 | A | | 12/1992 | Talberg |
| 5,491,899 | A | | 2/1996 | Schliemann et al. |
| 5,522,143 | A | | 6/1996 | Schliemann et al. |
| 5,528,835 | A | * | 6/1996 | Ra ..... 30/386 |
| 5,896,670 | A | | 4/1999 | Gibson et al. |
| 5,983,508 | A | | 11/1999 | Sundstrom |
| 6,049,986 | A | | 4/2000 | Calkins et al. |
| 6,061,915 | A | | 5/2000 | Seigneur et al. |
| 6,237,228 | B1 | | 5/2001 | Moody |
| 6,237,229 | B1 | | 5/2001 | Igawa et al. |
| 6,256,890 | B1 | | 7/2001 | Schliemann et al. |

* cited by examiner

*Primary Examiner*—Douglas D. Watts
(74) *Attorney, Agent, or Firm*—John P. McGonagle

(57) ABSTRACT

A cam lever arrangement is provided which permits the loosening and tightening of the chain on the chain saw blade tool with a simple lever motion. The lever arrangement is connected to the motor housing cover door. Opening the door automatically loosens the chain. Closing the door automatically tightens the chain. Precision adjustments to tension are easily made in the cam lever arrangement by hand manipulation of a turnbuckle which is free from pressure when the lever is in the release position.

18 Claims, 8 Drawing Sheets

LEVER CHAIN ADJUSTER FOR A CHAIN SAW

BACKGROUND OF THE INVENTION

This invention relates to chain saws, and in particular, to an improvement that enables the chain of a chain saw to be loosened or tightened without requiring loosening of locking nuts that secure a chain-carrying blade of the saw to the motor housing of the saw.

Chain saws include an elongated flat blade having a peripheral edge about which a cutting element, also known as a chain, extends in a continuous, endless loop. The distal free end of the chain is used for cutting. The proximal end of the chain extends around a sprocket gear that engages the chain and causes it to rotate around the peripheral edge of the elongated flat blade when the sprocket gear is rotated. The sprocket gear is attached to the output shaft of a motor means that is housed in a motor housing, and the proximal end of the elongated flat blade is secured to the motor housing.

An elongated slot is formed in the proximal end of the elongated flat blade, and a pair of externally threaded post members that are secured to the motor housing respectively extend through the slot. A pair of internally threaded locking nuts respectively threadingly engage the post members and securely lock the elongated flat blade against movement when the nuts are tightly sealed.

To tighten or loosen the chain, both locking nuts must be loosened. After the blade position is manipulated until the chain is loosened or tightened to a desired taughtness, the locking nuts must then be tightened again. It can take several minutes to perform the above-described procedure. The locking nuts are very tight, and must be loosened and re-tightened with a socket wrench or other high torque tool. This process is awkward and requires strength and a level place to brace the saw. It is not uncommon to drop one of the nuts requiring a search for the nut in the usual debris where chain saw operations generally take place. This further lengthens the time of the adjustment process.

Speed of adjustment may be an important factor in certain applications such as fire fighting where a quick loosening or tightening of the chain is important. Ease of adjustment actually has a safety element to it as chain saw users are likely to continue working with a dangerously loose chain as it stretches during use if it cannot easily be tightened.

SUMMARY OF THE INVENTION

The present invention addresses the above problems by providing an improvement to chain saws, wherein a simple cam lever arrangement is provided which permits the loosening and tightening of the chain on the chain saw blade tool with a simple lever motion. The lever arrangement is connected to a distal post member and to the sprocket cover door. Opening the door automatically loosens the chain. Closing the door automatically tightens the chain. Precision adjustments to tension are easily made in the lever arrangement by hand manipulation of a nut on a small threaded cylinder which is free from pressure when the lever is in the release position.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
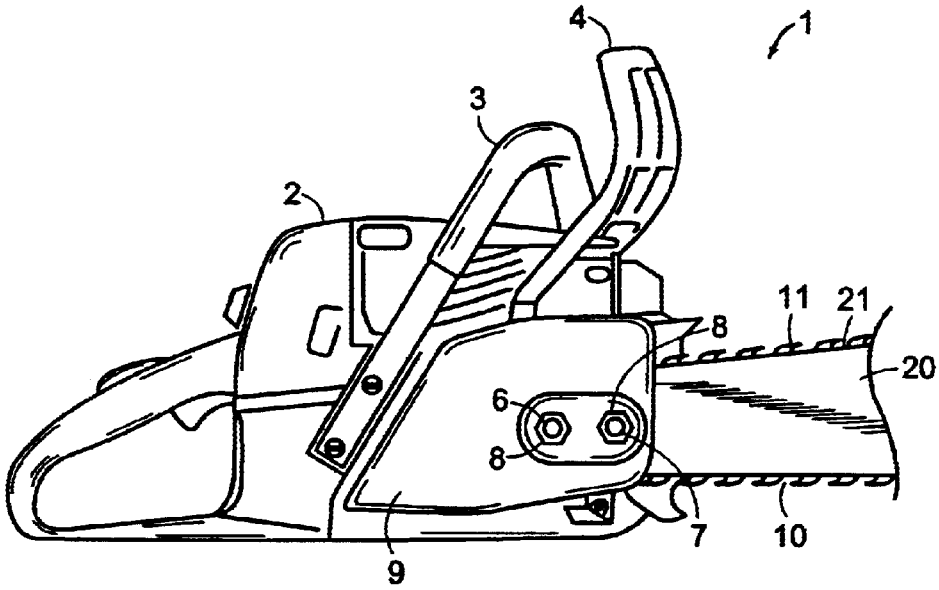
FIG. 1 PRIOR ART
FIG. 1 is a side elevational view of a chain saw of the prior art.
Figure 2:
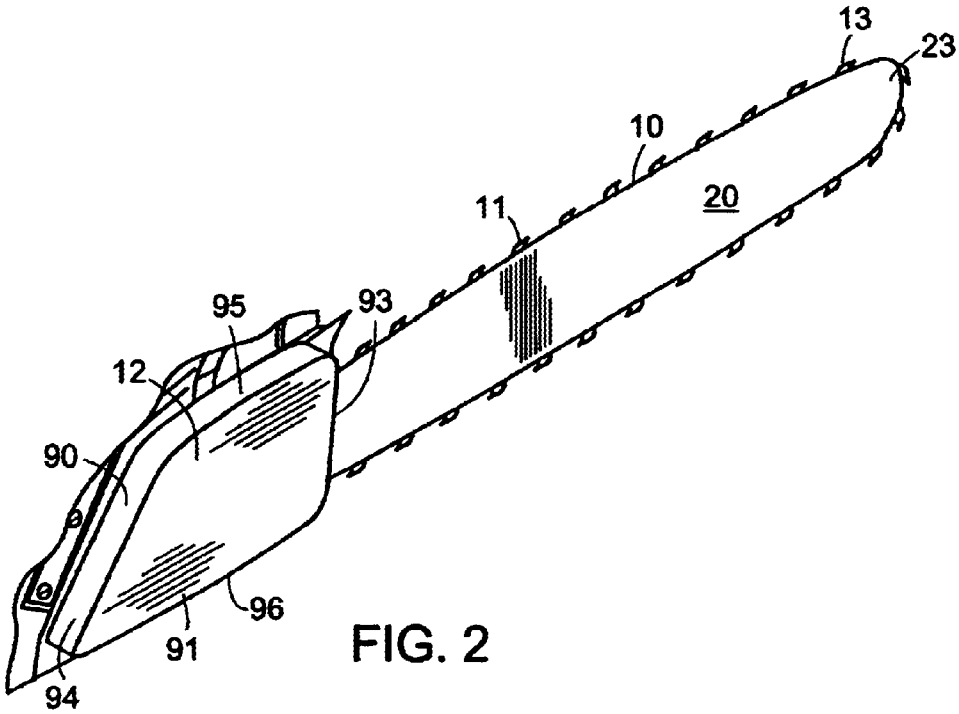
FIG. 2 is a perspective view of a chain saw modified in accordance with the present invention.
Figure 3:
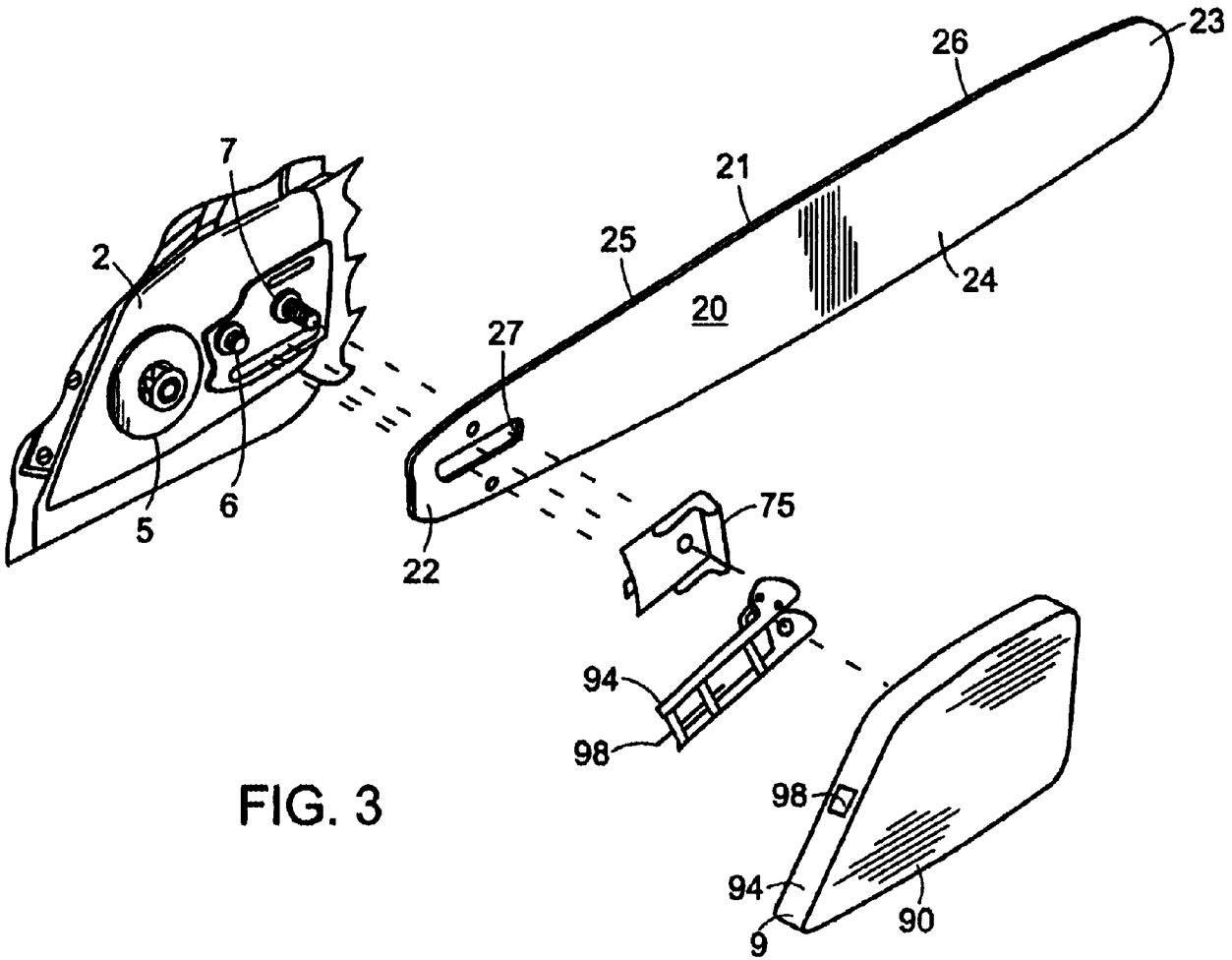
FIG. 3 is an exploded view of the chain saw of FIG. 2 modified to receive the present invention enhancements.

Referring to the drawings in detail wherein like elements are indicated by like numerals, there is shown a typical chain saw 1 comprised of a motor housing 2, a handle 3 attached to said housing 2, a safety shield 4 attached to each side of the housing 2, an elongated, flat, plate-like chain saw blade 20, and an endless chain 10 with cutting teeth 11, said chain 10 extending around the perimeter 21 of said blade 20. For purposes of exposition, the chain saw 1 is positioned in a horizontal orientation. The chain 10 extends in a continuous, endless loop. The proximal end 12 of the chain 10 extends around a sprocket gear 5 that engages the chain 10 and causes it to rotate around the peripheral edge 21 of the elongated flat blade 20 when the sprocket gear 5 is rotated. The sprocket gear 5 is attached to the output shaft (not shown) of a motor means (not shown) that is housed in a motor housing 2.

The chain saw flat blade 20 has a proximal end portion 22 and a distal end potion 23, said ends defining a horizontal, longitudinal axis, said flat blade proximal end portion 22 being secured to the motor housing 2. The flat blade 20 has an outer surface 24 and an inner surface 25, said surfaces interconnected by a perimeter edge 26, said flat blade surfaces 24, 25 lying in parallel vertical planes. The inner surface 25 is defined as that flat blade surface abutting the motor housing 2. The distal portion 13 of the chain 10 about the distal free end 23 of the flat blade 20 is used for cutting. An elongated slot 27 is formed through the flat blade proximal end portion 22, said slot 27 having a longitudinal axis coincident with the longitudinal axis of the flat blade 20. The chain saw 1 also has a removable cover 9 covering the flat blade proximal end 22 and chain 12 for safety reasons.

Normally, a pair of externally threaded post members 6, 7 that are secured to the motor housing 2 respectively extend through the slot 27. Normally, a pair of internally threaded locking nuts 8 respectively threadingly engage the post members 6, 7 and securely lock the flat blade 20 against movement when the nuts 8 are tightly sealed. Prior art chain saws loosen the locking nuts 8 and slide the flat blade 20 forward or backward to tighten or loosen the endless chain 10. When the desired position is attained the locking nuts 8 are tightened on the post members 6, 7 and the flat blade 20 held in place.

In this embodiment of the invention, the rearmost post member 6 is shortened so that the post member portion extending through the flat blade slot 27 is removed. The conventional flat blade 20 is also modified by the addition of one or more holes threaded 28 in the flat blade proximal end portion 22.

The present invention includes a turnbuckle assembly 30 comprised in part of a holding plate subassembly 31 and a turnbuckle 40, and a cam assembly 60 with a base plate 100. The turnbuckle 40 interconnects the turnbuckle assembly 30 with the cam assembly 60.

Figure 6:
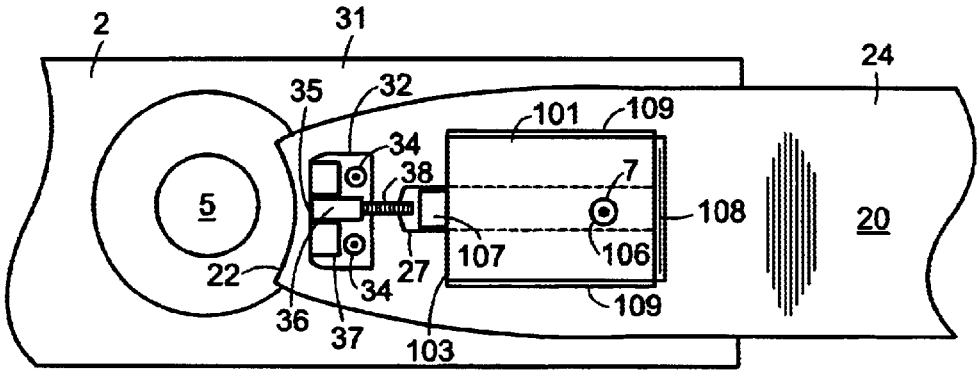
FIG. 6 is a side view of the chain saw view of FIG. 4 with a turnbuckle holding plate and base plate installed.
Figure 7:
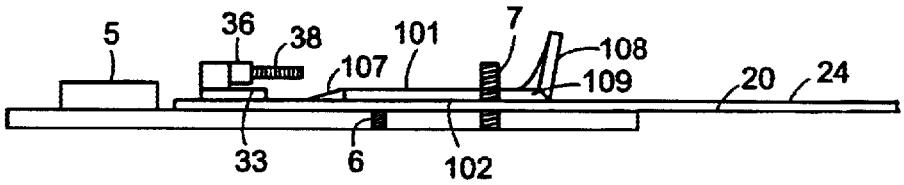
FIG. 7 is a top view of FIG. 6.
Figure 9:
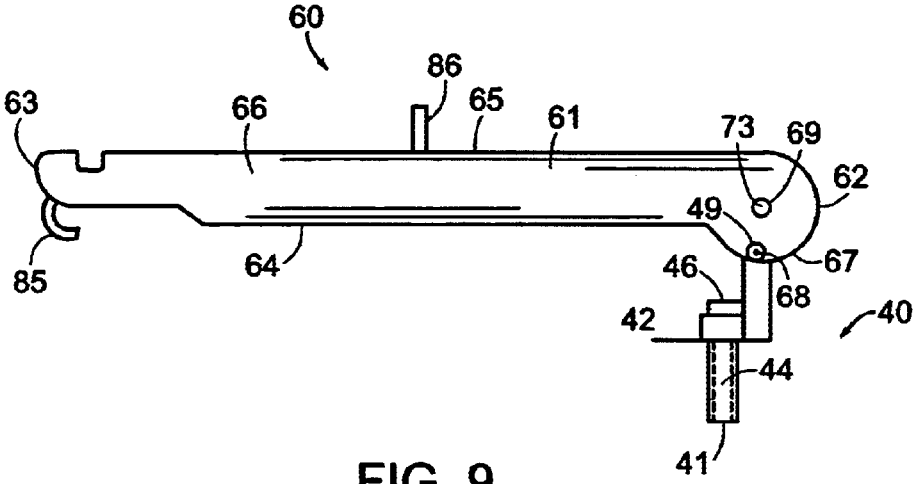
FIG. 9 is a top view of the cam assembly shown in FIG. 8.
Figure 8:
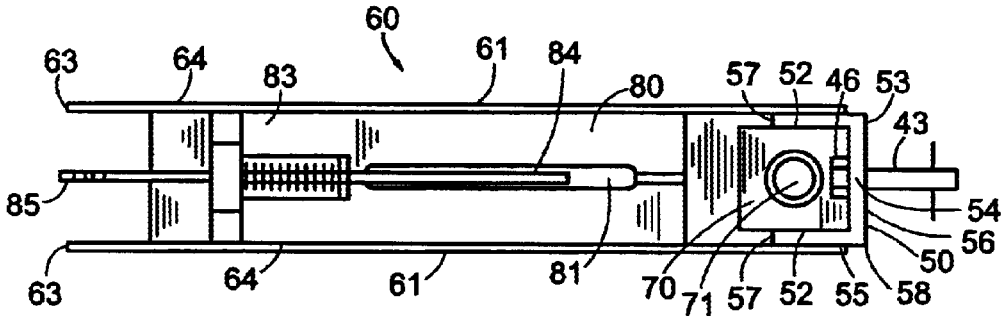
FIG. 8 is a side view of the cam assembly.
Figure 10:
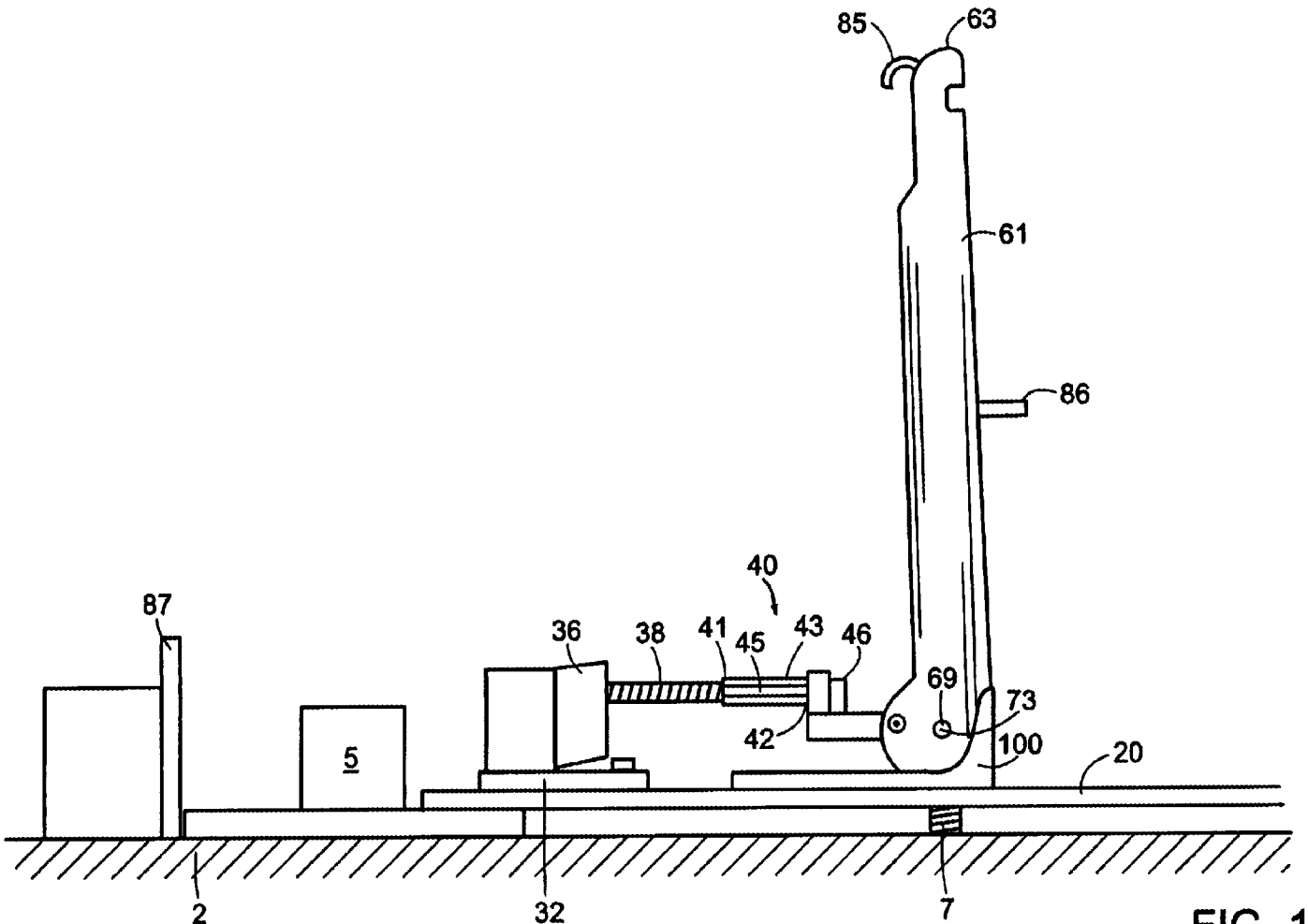
FIG. 10 is a top view of the chain saw view of FIG. 4 with a turnbuckle holding plate, base plate and cam assembly installed and in an open position.
Figure 11:
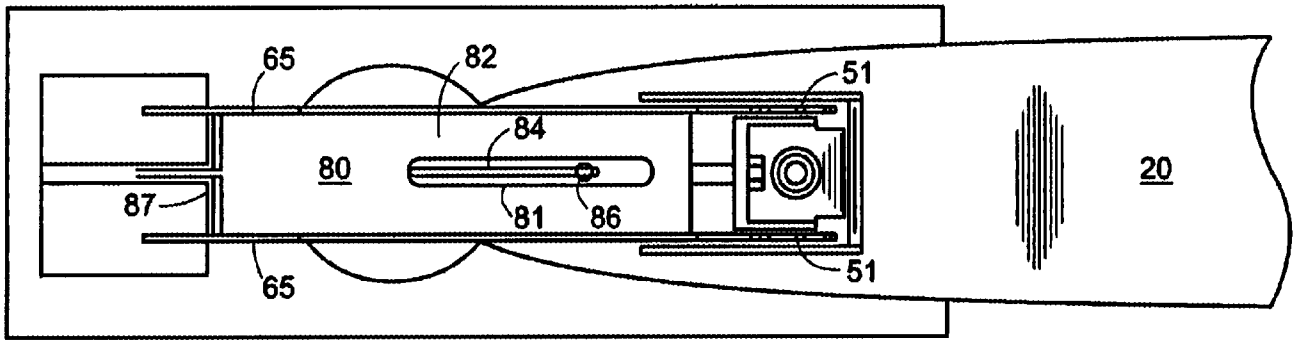
FIG. 11 is a side view of FIG. 10 in a closed position.
Figure 12:
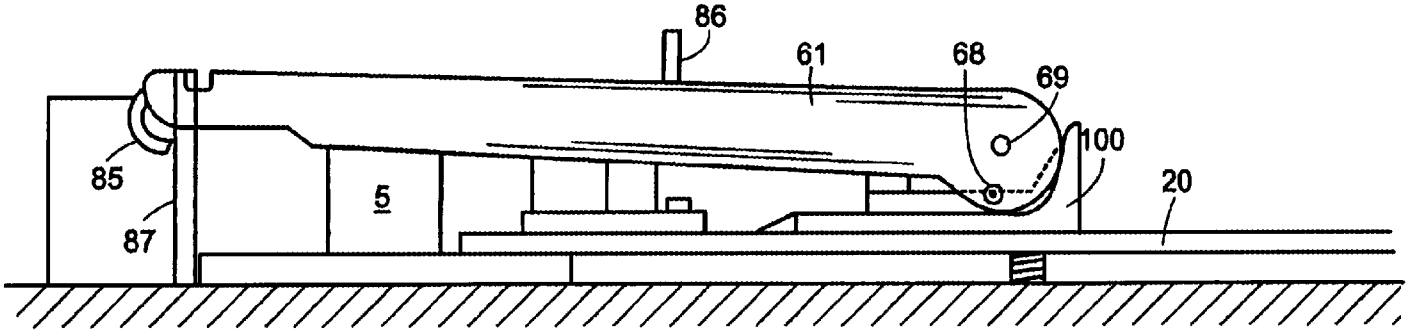
FIG. 12 is a top view of FIG. 11.
Figure 13:
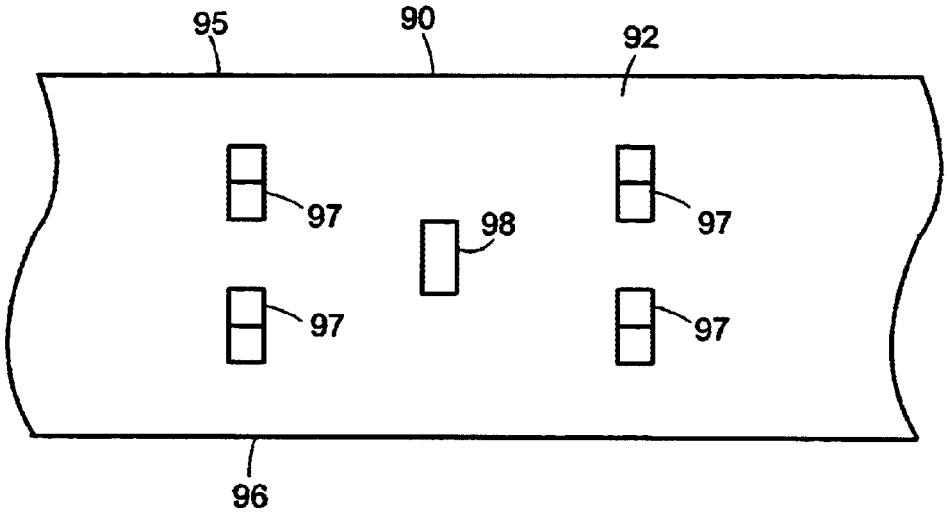
FIG. 13 is a view of the cover inside surface.
Figure 14:
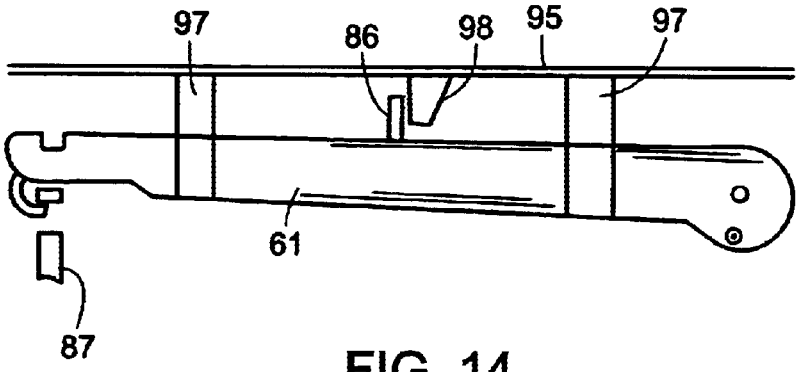
FIG. 14 is a top view of the cover with cam levers attached.

The holding plate subassembly 31 is comprised of a flat holding plate 32 with one or more holes a hole 33 formed therethrough, said holding plate 31 being connected to the flat blade outer surface 24 by means of one or more threaded screws 34 inserted into the holding plate hole 32 and engaging one or more of the flat blade threaded holes 28. The holding plate 31 has a pivot element 35 attached thereto, pivotally interconnecting a screw socket element 36 with said holding plate 31. The screw socket element 36 has a central, round aperture 37 formed therein. An elongated threaded screw 38 is inserted into said aperture 37, wherein said threaded screw 38 extends forwardly in a distal direction generally parallel to the longitudinal axis of the flat blade 20. The threaded screw 38 is adapted to threadingly engage a turnbuckle 40 as is described more fully below. See FIGS. 6 and 7.

Figure 5:
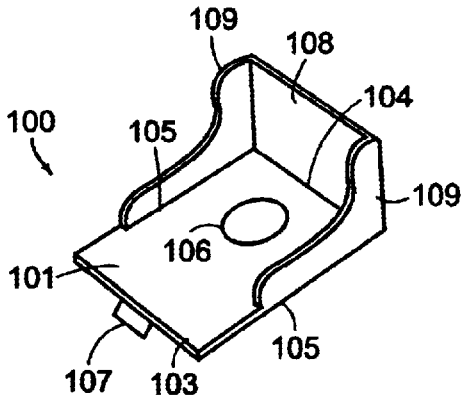
FIG. 5 is a perspective view the invention base plate.
Figure 4:
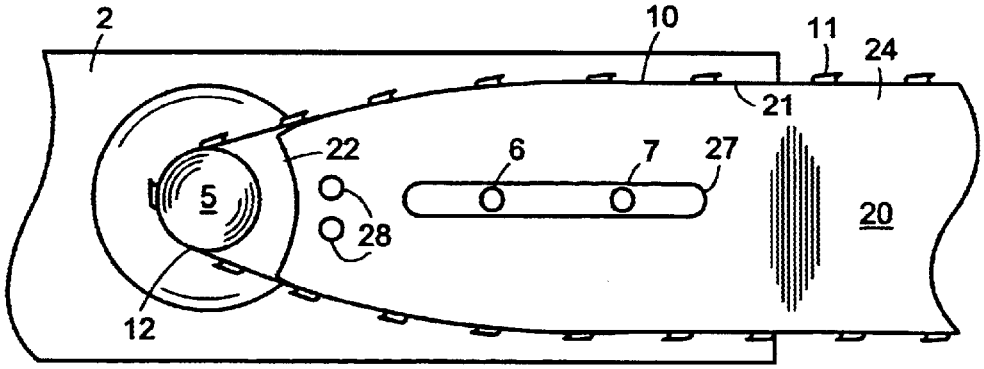
FIG. 4 is a side view of an unmodified chain saw with the cover removed.

The base plate 100 has an outer surface 101, an inner surface 102, a proximal end 103, a distal end 104, and two opposing, parallel sides 105, said proximal end 103 and distal end 104 defining a base plate longitudinal axis. The base plate 100 has an aperture 106 formed therein, at a selected position along the central longitudinal axis of the base plate 100. The base plate proximal end 103 has a stabilizer tab 107 formed thereon, said stabilizer tab 107 protruding at an angle past the base plate inner surface 102. The base plate distal end 104 has a distal end flange 108 formed thereon, said distal end flange 108 extending past the base plate outer surface 101 at an approximate 90° angle to the plate outer surface 101. The base plate sides 105 each have a side flange 109 formed thereon, said side flanges 109 extending past the base plate outer surface 101 at an approximate 90° angle to the plate outer surface 101. See FIG. 5.

The base plate 100 is adapted to being set onto the flat blade outer surface 24 wherein said base plate aperture 106 is adapted to fit over the chain saw foremost post member 7. The base plate longitudinal axis is coincident with the longitudinal axis of the flat blade 20. The base plate 100 is positioned so that the base plate proximal end 103 is oriented toward the flat blade proximal end 22, and the base plate distal end 104 is oriented toward the flat blade distal end 23. The base plate stabilizer tab 107 is adapted to fit into the flat blade elongated slot 27. The base plate inner surface 102 is that surface positioned against the flat blade outer surface 24. See FIGS. 6 and 7.

The turnbuckle 40 is comprised of a cylindrical body 43 having a proximal end 41 and a distal end 42, said proximal end 41 and distal end 42 defining a turnbuckle longitudinal axis, said turnbuckle longitudinal axis being parallel to said flat blade longitudinal axis. The turnbuckle 40 has a central, longitudinal, threaded aperture 44 formed therein extending from said proximal end 41 to said distal end 42. The holding plate subassembly threaded screw 38 engages the turnbuckle threaded aperture 44 entering first at the turnbuckle proximal end 41. The turnbuckle cylindrical body distal end 42 terminates in a round retaining end cap 46. The cylindrical body 43 may also have a textured external surface 45.

As stated above the turnbuckle 40 interconnects the turnbuckle assembly 30 with the cam assembly 60. This is done by means of a U-shaped bracket 50 with two parallel elongated members 52 interconnected by a transverse cross member 53. The cross member 53 has a central aperture 54 formed therein. The cross member central aperture 54 is adapted to receive the cylindrical body 43 wherein the turnbuckle cylindrical body distal end round retaining end cap 46 has a diameter greater than the cross member central aperture 54. The turnbuckle cylindrical body distal end round retaining end cap 46 is positioned on one side 55 of the cross member opposite a side 56 facing the rest of the turnbuckle 40. The turnbuckle cylindrical body distal end round retaining end cap 46 is on the same cross member side 55 as the two parallel elongated members 52.

The parallel elongated members 52 have free ends 57 opposite the ends 58 joined to the cross member 52. The two ends 57, 58 of each elongated member 52 define the longitudinal axis of each member, said elongated member longitudinal axis being normally parallel to the flat blade longitudinal axis. Each elongated member 52 has a lateral aperture 51 formed therein near to said member free end 57, each said lateral aperture 51 having a central axis parallel to the cross member 53.

The turnbuckle assembly 30 engages the invention cam assembly 60 by means of the U-shaped bracket 50. The cam assembly 60 is comprised of two, generally parallel, elongated cam levers 61 and an interconnecting pivot subassembly 70. Each cam lever 61 has two ends, a cam end 62 and a lever end 63, said ends defining a longitudinal axis for each cam lever 61. Each cam lever 61 has an elongated camming edge 64, an opposite engagement edge 65, and two flat, opposing interconnecting sides 66. The elongated camming edge 64 has an irregular, curvilinear cam surface 67 formed near to the cam end 62. Each cam lever 61 has two lateral apertures formed therein along the cam lever longitudinal axis, extending through the interconnecting sides 66, a first aperture 68 near to the cam end 62 and a second aperture 69 a specified longitudinal distance from the first aperture 68. The U-shaped bracket 50 is attached to the cam assembly 60 by means of a fastener 49 inserted through each cam lever first aperture 68 into each U-shaped bracket elongated member lateral aperture 51 respectively. The purpose of the base plate 100 is to hold the entire cam assembly firmly in place and to spread cam pressure to a wider area for additional stability with bigger chain saws. The cam lever cam surfaces 67 each strike an area on the base plate outer surface 101.

The pivot subassembly 70 is comprised of a pivot ring 71 in a rectangular holding plate 72. The pivot ring 71 is adapted to fit over the foremost post member 7. The holding plate 72 has two opposite, lateral, small arms 73, each extending through a cam lever second aperture 69. The holding plate 72 is held securely to the post member 7 by a threaded nut 74 and lock-washer. In an alternate embodiment, the foremost post member 7 would have two side holes adapted to receive two spring-forced locking pins from an overlapping sleeve. A user would thus not need to turn and tighten a nut in a small space but simply would drop the sleeve over the post to lock onto the post member 7. The sleeve would be releasable by finger pinching two mini-levers on top of the sleeve.

As stated above most chain saws will also have a removable cover 9 covering the flat blade proximal end 22 and chain 12 for safety reasons. This cover 9 is modified for the present invention resulting in cover 90. The cover 90 has an outside surface 91, inside surface 92, front 93, rear 94, top 95 and bottom 96. The cover front 93 is defined as that part of the cover 90 closest to the flat blade distal end 23 when the cover 90 is closed over the flat blade proximal end 22 and chain 12. The cover rear 94 may slant forward from bottom 96 to top 95 due to the position of the chain saw handle 3. The cover exterior surface 91 is entirely smooth with no bolts, nuts, turning mechanisms or latch releases exposed to dirt when the chain saw is operated horizontally to cut stumps off close to the ground.

The cover inside surface 92 is modified by the addition of two sets of holding rails 97, said rails being adapted to slide over the cam levers 61, slidably holding the cam lever engagement edges 65 adjacent the cover inside surface 92. A unique feature on the present embodiment is a slide-action cover serving several purposes. Manually sliding the cover rearward disengages a cam assembly latch 85 that is completely protected underneath the cover 90. To attain this feature, a push block 98 is installed on the cover inside surface 92 and the cam assembly 60 is modified.

The cam levers 61 are interconnected by a plate 80 interconnecting the parallel lever sides 66. The plate 80 extends centrally a predetermined distance toward the lever cam ends 62 and lever ends 63. The plate 80 has a central opening 81 formed therein, said central opening 81 having a longitudinal axis parallel to the longitudinal axes of the cam levers 61. The plate has an exterior surface 82 and an interior surface 83, said exterior surface 82 being adjacent the cam lever engagement edges 65 and said interior surface 83 being adjacent the cam lever camming edges 64. A spring-loaded L-shaped rod 84 is secured to the plate interior surface 83 and positioned so that the rod 90° end 86 protrudes through the central opening 81. The other end of the rod terminates in a latch-hook 85 bending away from the plate interior surface 83.

The cover push block 98 engages the rod 90° end 86 so that pulling the cover rearward, causes the rod 90° end 86 to move rearward, thereby causing the latch 85 to move rearward and release from the latching bar 87 installed on the motor housing 2 to the rear of the sprocket gear 5. The cover 90 can then be swung open thereby releasing and opening the cam levers 61.

In operation, as the cover 90 is closed the cam levers 61 pivot about the pivot assembly pivot ring 71 on the post member 7 pulling the turnbuckle assembly U-shaped bracket 50 forward. This in turn forces the holding plate 32 and attached flat blade 20 forward. The endless chain 10 about the flat blade perimeter 21 must also attempt to move forward. Because the endless chain 10 is anchored by the sprocket gear 5, the result is that the endless chain becomes stretched, i.e., tightened. As the cover becomes completely closed, the cam lever camming edge 64 becomes parallel to the flat blade outer surface 24, and the cam surface 67 engages the base plate outer surface 101, thereby holding the cam levers 61 and attached cover 90 in a closed position. The tension between cam assembly 60 and flat blade 20 is adjustable by means of the turnbuckle assembly turnbuckle 40. Turning the turnbuckle 40 moves the turnbuckle in either direction along the screw threaded body 38. The endless chain 10 about the flat blade 20 may be loosened by the reverse operation of opening the cover 90.

It is understood that the above-described embodiment is merely illustrative of the application. For safety, a spring bolt 98 or other latching means may be added to the cover rear 94 for locking engagement with chain saw housing 2. Other embodiments may be readily devised by those skilled in the art which will embody the principles of the invention and fall within the spirit and scope thereof.

I claim:

1. A lever chain adjuster for a chain saw having a motor housing, an elongated, flat, plate-like chain saw blade, and an endless chain with cutting teeth, said chain extending around a peripheral edge of said elongated flat blade, said chain extending in a continuous, endless loop, said chain having a proximal end extending around a sprocket gear that engages the chain and causes it to rotate around said peripheral edge of the elongated flat blade when the sprocket gear is rotated, said sprocket gear being attached to an output shaft of a motor means housed within said motor housing, comprising:

said elongated flat blade having a proximal end portion and a distal end potion, said ends defining a horizontal, longitudinal axis, said elongated flat blade proximal end portion being secured to the motor housing, said elongated flat blade having an outer surface and an inner surface, said surfaces interconnected by a peripheral edge, said elongated flat blade surfaces lying in parallel vertical planes, said inner surface being defined as that elongated flat blade surface abutting the motor housing, said elongated flat blade having an elongated slot formed through the elongated flat blade proximal end portion, said slot having a longitudinal axis coincident with the longitudinal axis of the elongated flat blade, said elongated flat blade proximal end portion having a plurality of threaded holes formed therein;

a pair of externally threaded post members, a proximal post member and a distal post member, secured to the motor housing and extending through said elongated flat blade elongated slot, said proximal post member being shortened so that no portion of the proximal post member protrudes through said elongated flat blade elongated slot;

a turnbuckle assembly having a holding plate subassembly connected to said elongated flat blade proximal end portion threaded holes and a turnbuckle;

a cam assembly with a base plate, said turnbuckle interconnecting the turnbuckle assembly with the cam assembly; and a removable cover attached to said cam assembly adapted for covering the elongated flat blade proximal end and chain proximal end.

2. A lever chain adjuster as recited in claim 1, wherein said holding plate subassembly is comprised of:

a flat holding plate with a plurality of holes formed therethrough, said holding plate being connected to the elongated flat blade outer surface by a plurality of fasteners inserted into the holding plate hole and engaging the elongated flat blade threaded holes;

a pivot element attached to the holding plate;

a screw socket element interconnected by said pivot element with said holding plate, said screw socket element having a central, round aperture formed therein; and an elongated threaded screw inserted into said aperture, wherein said threaded screw extends forwardly in a distal direction generally parallel to the longitudinal axis of the flat blade, said threaded screw adapted to threadingly engage said turnbuckle.

3. A lever chain adjuster as recited in claim 2, wherein:

said base plate has an outer surface, an inner surface, a proximal end, a distal end, and two opposing, parallel sides, said proximal end and distal end defining a base plate longitudinal axis, said base plate having an aperture formed therein, at a selected position along the central longitudinal axis of the base plate, said base plate proximal end having a stabilizer tab formed thereon, said stabilizer tab protruding at an angle past the base plate inner surface, said base plate distal end having a distal end flange formed thereon, said distal end flange extending past the base plate outer surface at an approximate 90° angle to the plate outer surface, said base plate sides each having a side flange formed thereon, said side flanges extending past the base plate outer surface at an approximate 90° angle to the plate outer surface, said base plate adapted to being set onto the flat blade outer surface wherein said base plate aperture is adapted to fit over said distal post member, said base plate longitudinal axis being coincident with the longitudinal axis of the elongated flat blade, said base plate being positioned so that the base plate proximal end is oriented toward the flat blade proximal end, and the base plate distal end is oriented toward the flat blade distal end, said base plate tab being adapted to fit into the elongated flat blade elongated slot, said base plate inner surface being that surface positioned against the flat blade outer surface.

4. A lever chain adjuster as recited in claim 3, wherein:

the turnbuckle is comprised of a cylindrical body having a proximal end and a distal end, said proximal end and distal end defining a turnbuckle longitudinal axis, said turnbuckle longitudinal axis being parallel to said elongated flat blade longitudinal axis, said turnbuckle having a central, longitudinal, threaded aperture formed therein and extending from said proximal end to said distal end, wherein said holding plate subassembly threaded screw is adapted to engage the turnbuckle threaded aperture entering first at the turnbuckle proximal end, said turnbuckle cylindrical body distal end terminating in a round retaining end cap.

5. A lever chain adjuster as recited in claim 4, further comprising a U-shaped bracket adapted to interconnect the turnbuckle assembly with the cam assembly, said U-shaped bracket comprising:

two parallel elongated members, each having a free end and an opposite end joined to a transverse cross member, each elongated member's two ends defining a longitudinal axis of each member, said elongated member longitudinal axis being normally parallel to the flat blade longitudinal axis, each elongated member having a lateral aperture formed therein near to said member free end, each said lateral aperture having a central axis parallel to the cross member; and said transverse cross member interconnecting said two parallel elongated members, said cross member having a central aperture formed therein, said cross member central aperture adapted to receive the turnbuckle cylindrical body wherein the turnbuckle cylindrical body distal end cap has a diameter greater than the cross member central aperture, said turnbuckle cylindrical body distal end round retaining end cap being positioned on one side of the cross member opposite a cross member side facing the a substantial portion of the turnbuckle, said turnbuckle cylindrical body distal end round retaining end cap being on the same cross member side as the two parallel elongated members.

6. A lever chain adjuster as recited in claim 5, wherein said cam assembly is comprised of:

two, generally parallel, elongated cam levers, each said cam lever having two ends, a cam end and a lever end, said ends defining a longitudinal axis for each cam lever, each said cam lever having an elongated camming edge, an opposite engagement edge, and two flat, opposing interconnecting sides, each said cam lever having two lateral apertures formed therein along the cam lever longitudinal axis, extending through the interconnecting sides, a first aperture near to the cam end and a second aperture a specified longitudinal distance from the first aperture;

a pivot subassembly interconnecting said cam levers, said pivot subassembly being comprised of a pivot ring in a rectangular holding plate, said pivot ring adapted to fit over the distal post member;

wherein the U-shaped bracket is attached to the cam assembly by a fastener inserted through each cam lever first aperture into each U-shaped bracket elongated member lateral aperture.

7. A lever chain adjuster as recited in claim 6, wherein:

the holding plate has two opposite, lateral, small arms, each extending through a cam lever second aperture;

wherein said holding plate is held securely to the distal post member by a threaded nut and lock-washer engaging said distal post member.

8. A lever chain adjuster as recited in claim 7, wherein:

the removable cover has an outside surface, inside surface, front, rear, top and bottom, said cover front being a part of the cover closest to the flat blade distal end when the cover is closed over the flat blade proximal end and chain, said cover inside surface having two sets of holding rails, said rails being adapted to slide over the cam levers, slidably holding the cam lever engagement edges adjacent the cover inside surface, said inside surface having an attached push block.

9. A lever chain adjuster as recited in claim 8, wherein said cam assembly is further comprised of:

a plate interconnecting the parallel lever sides, said plate extending centrally a predetermined distance toward the lever cam ends and lever ends, said plate having a central opening formed therein, said central opening having a longitudinal axis parallel to the longitudinal axes of the cam levers, said plate has an exterior surface and an interior surface, said exterior surface being adjacent the cam lever engagement edges and said interior surface being adjacent the cam lever camming edges;

a spring-loaded L-shaped rod secured to the plate interior surface and positioned so that a rod 90° end protrudes through the central opening, said rod having an opposite end of the rod terminating in a latch-hook bending away from the plate interior surface, said latch-hook adapted to engage a latching bar attached to the motor housing adjacent the sprocket gear.

10. A lever chain adjuster as recited in claim 9, wherein:

said removable cover inside surface push block is adapted to engage and move the rod 90° end when the cover is moved rearward, thereby moving the latch-hook rearward and releasing the latching bar.

11. A lever chain adjuster as recited in claim 10, wherein:

said turnbuckle cylindrical body has a textured external surface.

12. A lever chain adjuster as recited in claim 11, wherein:

the elongated camming edge has an irregular, curvilinear cam surface formed near to the cam end.

13. A lever chain adjuster as recited in claim 5, wherein said cam assembly is comprised of:

two, generally parallel, elongated cam levers, each said cam lever having two ends, a cam end and a lever end, said ends defining a longitudinal axis for each cam lever, each said cam lever having an elongated camming edge, an opposite engagement edge, and two flat, opposing interconnecting sides, each said cam lever having two lateral apertures formed therein along the cam lever longitudinal axis, extending through the interconnecting sides, a first aperture near to the cam end and a second aperture a specified longitudinal distance from the first aperture;

two side holes in said distal post member;

a pivot subassembly interconnecting said cam levers, said pivot subassembly being comprised of an overlapping sleeve with two releasable, internal spring-forced locking pins adapted to fit over said distal post member and inserting said locking pins into said distal post member side holes, said sleeve having two opposite, lateral, external, small arms, each extending through a cam lever second aperture;

wherein the U-shaped bracket is attached to the cam assembly by a fastener inserted through each cam lever first aperture into each U-shaped bracket elongated member lateral aperture.

14. A lever chain adjuster as recited in claim 13, wherein:

the removable cover has an outside surface, inside surface, front, rear, top and bottom, said cover front being a part of the cover closest to the flat blade distal end when the cover is closed over the flat blade proximal end and chain, said cover inside surface having two sets of holding rails, said rails being adapted to slide over the cam levers, slidably holding the cam lever engagement edges adjacent the cover inside surface, said inside surface having an attached push block.

15. A lever chain adjuster as recited in claim 14, wherein said cam assembly is further comprised of:

a plate interconnecting the parallel lever sides, said plate extending centrally a predetermined distance toward the lever cam ends and lever ends, said plate having a central opening formed therein, said central opening having a longitudinal axis parallel to the longitudinal axes of the cam levers, said plate has an exterior surface and an interior surface, said exterior surface being adjacent the cam lever engagement edges and said interior surface being adjacent the cam lever camming edges;

a spring-loaded L-shaped rod secured to the plate interior surface and positioned so that a rod 90° end protrudes through the central opening, said rod having an opposite end of the rod terminating in a latch-hook bending away from the plate interior surface, said latch-hook adapted to engage a latching bar attached to the motor housing adjacent the sprocket gear.

16. A lever chain adjuster as recited in claim 15, wherein:

said removable cover inside surface push block is adapted to engage and move the rod 90° end when the cover is moved rearward, thereby moving the latch-hook rearward and releasing the latching bar.

17. A lever chain adjuster as recited in claim 16, wherein:

said turnbuckle cylindrical body has a textured external surface.

18. A lever chain adjuster as recited in claim 17, wherein:

the elongated camming edge has an irregular, curvilinear cam surface formed near to the cam end.

* * * * *